US006085364A

United States Patent [19]

Baierlein

[11] Patent Number: 6,085,364

[45] Date of Patent: Jul. 11, 2000

[54] RECHARGEABLE BATTERY SYSTEM FOR A MARINE VESSEL TOILET

[75] Inventor: Richard E. Baierlein, Newport, R.I.

[73] Assignee: Wilcox Crittenden, Inc., Waterford, Conn.

[21] Appl. No.: 09/375,582

[22] Filed: Aug. 17, 1999

Related U.S. Application Data

[63] Continuation-in-part of application No. 09/163,486, Sep. 30, 1998, Pat. No. 5,987,658.

[51] Int. Cl.[7] ..... E03D 9/10; H01M 2/10

[52] U.S. Cl. ..... 4/300; 4/319; 4/433; 429/100; 318/105

[58] Field of Search ..... 4/300, 319–323, 4/431–433; 429/7, 9, 97, 100; 324/427; 318/105, 106, 109, 107

[56] References Cited

U.S. PATENT DOCUMENTS

| | | | |
|---|---|---|---|
| D. 298,029 | 10/1988 | Foster | D13/8 |
| 3,275,550 | 9/1966 | Daubenspeck | 4/319 |
| 3,439,361 | 4/1969 | Moore | 4/319 |
| 3,699,592 | 10/1972 | Minchak | 4/320 |
| 3,727,241 | 4/1973 | Drouhard, Jr. et al. | 4/319 |
| 3,878,569 | 4/1975 | Peirish, Jr. et al. | 4/319 |
| 4,115,876 | 9/1978 | Cole, Jr. et al. . | |
| 4,185,337 | 1/1980 | Sargent et al. . | |
| 4,516,281 | 5/1985 | MacPherson et al. | 4/319 |
| 4,756,978 | 7/1988 | Nitcher et al. | 429/96 |
| 4,868,932 | 9/1989 | Thoma et al. . | |
| 4,905,325 | 3/1990 | Colditz . | |
| 4,926,508 | 5/1990 | Sargent et al. . | |
| 5,532,080 | 7/1996 | Mizoguchi et al. | 429/164 |
| 5,551,097 | 9/1996 | Short . | |
| 5,557,810 | 9/1996 | Antos et al. . | |
| 5,656,919 | 8/1997 | Proctor et al. | 320/30 |
| 5,734,254 | 3/1998 | Stephens | 320/106 |
| 5,987,658 | 11/1999 | Richards et al. | 4/300 |

*Primary Examiner*—Charles R. Eloshway
*Attorney, Agent, or Firm*—Salter & Michaelson

[57] ABSTRACT

A battery system for an electric motor-powered marine vessel toilet is disclosed. The battery system comprises a mounting cradle and a battery having power contacts, the battery being detachably mounted to the mounting cradle. The mounting cradle includes cradle contacts for mating with the contacts of the battery, output contacts for providing power to the motor of the marine vessel toilet, auxiliary contacts for receiving power from an auxiliary power source; and a switch for connecting the output contact to one of the cradle contacts and the auxiliary contacts for supplying power to the motor via the output contacts.

11 Claims, 11 Drawing Sheets

RECHARGEABLE BATTERY SYSTEM FOR A MARINE VESSEL TOILET

CROSS-REFERENCE TO RELATED APPLICATION

This is a continuation-in-part of U.S. patent application Ser. No. 09/163,486, filed Sep. 30, 1998, now U.S. Pat. No. 5,987,658.

BACKGROUND OF THE INVENTION

1. Field of the Invention

The present invention generally relates to a marine vessel toilet system, and more particularly to a marine vessel toilet system having a rechargeable battery system which can either be used as the primary power source for an electric marine vessel toilet or as a supplemental power source for the marine vessel toilet.

2. Discussion of the Related Art

Marine vessel toilet systems have several operational requirements which are different from household toilet systems. One difference is that the bowl of the marine vessel toilet system is generally dry when the toilet is not in use, since the motion of the marine vessel could cause any water in the bowl to splash out of the bowl. It is also desirable to minimize the amount of water used to fill the bowl when it is used. This is because the toilet bowl is often evacuated to a holding tank for later disposal. Therefore, it is important to keep the amount of water held in the holding tank to a minimum. Furthermore, in some cases, the water input to the toilet bowl is drawn from the marine vessel's fresh water supply, in order to minimize any odors. Due to the finite amount of fresh water which can be stored on a vessel, it is important to minimize the amount of water used to operate the toilet system. The inventors of the present invention have found that electric toilets can be designed to use less water than their manually-operated counterparts.

However, on most small to medium-size boats, the common standard marine toilet is one that operates manually, rather than an electric-powered toilet. One of the reasons for this is the fact that electric toilets are generally more expensive than manual toilets. Another reason for the preference for manual toilets is the limited amount of power available on smaller marine vessels. Generally, a limited number of rechargeable batteries, hereinafter called "house" batteries, are used to supply power to the equipment on the boat, particularly the navigation systems, radios and other marine electronics, and also for starting the vessels motor(s). Due to the importance of the equipment which is being powered by the house batteries, many boaters are not willing to risk running out of power during a cruise because of the drain on the house batteries caused by an electric toilet. Therefore, many boaters elect to forego the convenience of an electric toilet in order to conserve the house batteries on the marine vessel.

What is needed, therefore, is a self-contained rechargeable battery system which can be used to power an electric marine vessel toilet, which will enable the use of an electric toilet on a marine vessel without relying on the vessel's house batteries for power.

SUMMARY OF THE INVENTION

The present invention provides a marine vessel toilet system which includes a rechargeable battery system for providing power to the marine vessel toilet. The system allows the use of the rechargeable battery for the primary power source, while also allowing an auxiliary power source to be connected to the motor of the toilet.

According to a first embodiment of the invention, a battery system for an electric motor-powered marine vessel toilet is disclosed. The battery system comprises a mounting cradle and a battery having power contacts, the battery being detachably mounted to the mounting cradle. The mounting cradle includes cradle contacts for mating with the contacts of the battery, output contacts for providing power to the motor of the marine vessel toilet, auxiliary contacts for receiving power from an auxiliary power source; and a switch for connecting the output contact to one of the cradle contacts and the auxiliary contacts for supplying power to the motor via the output contacts.

Other features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION

Figure 1:
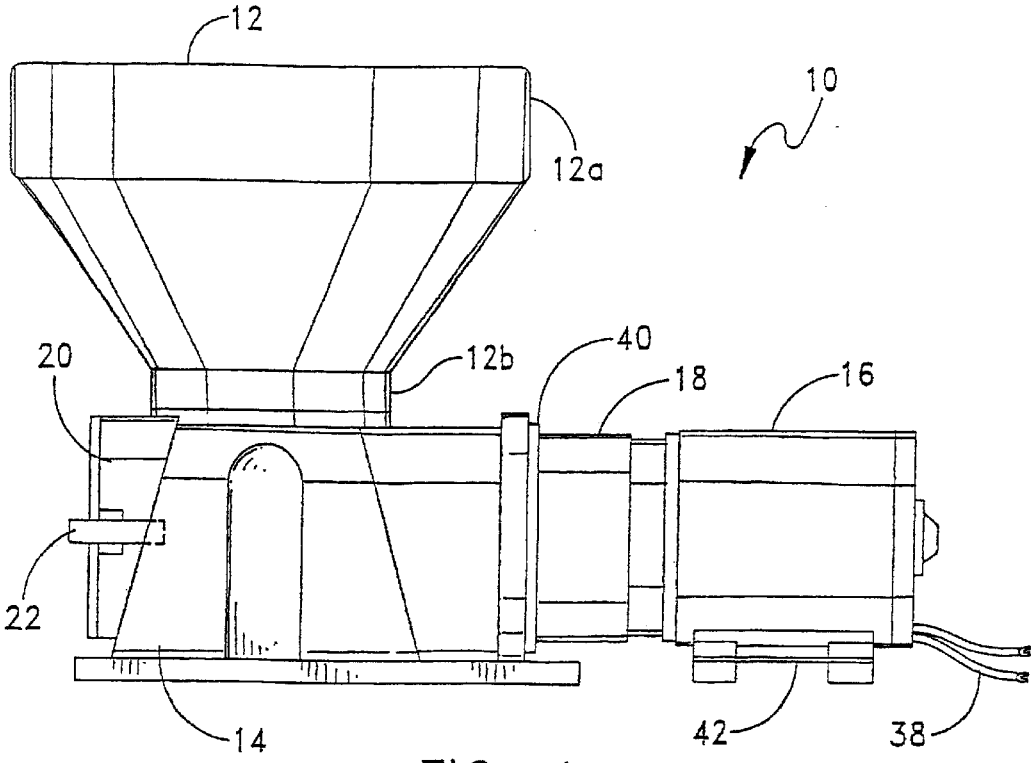
FIG. 1 is a side view of the toilet system of the present invention.
Figure 2:
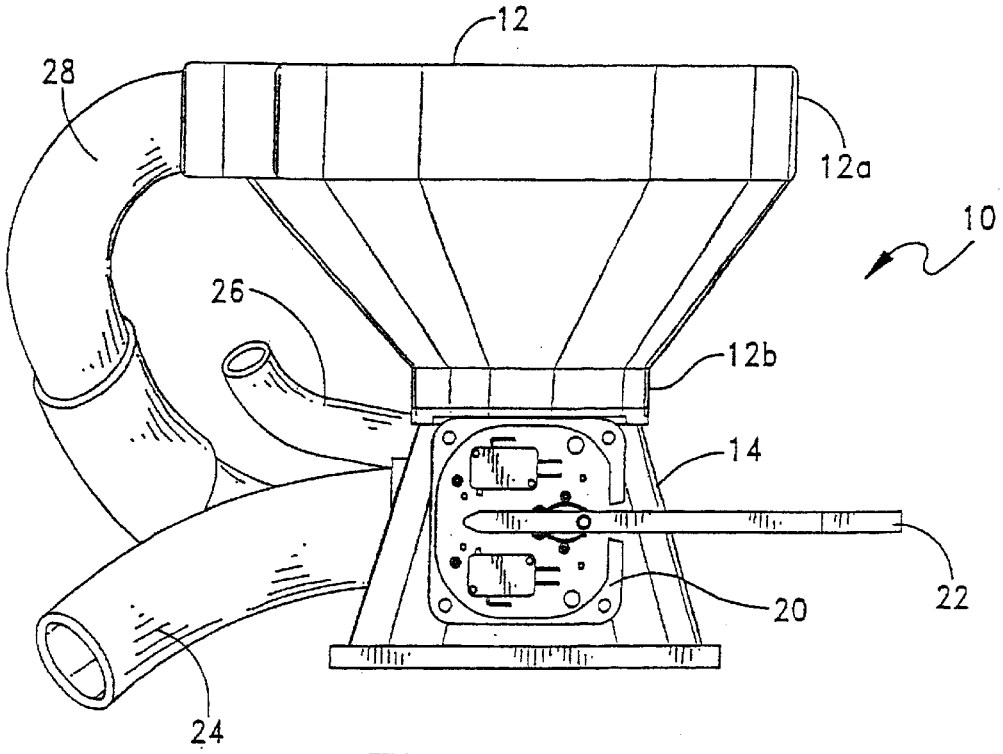
FIG. 2 is a front view of the toilet system of the present invention.
Figure 3:
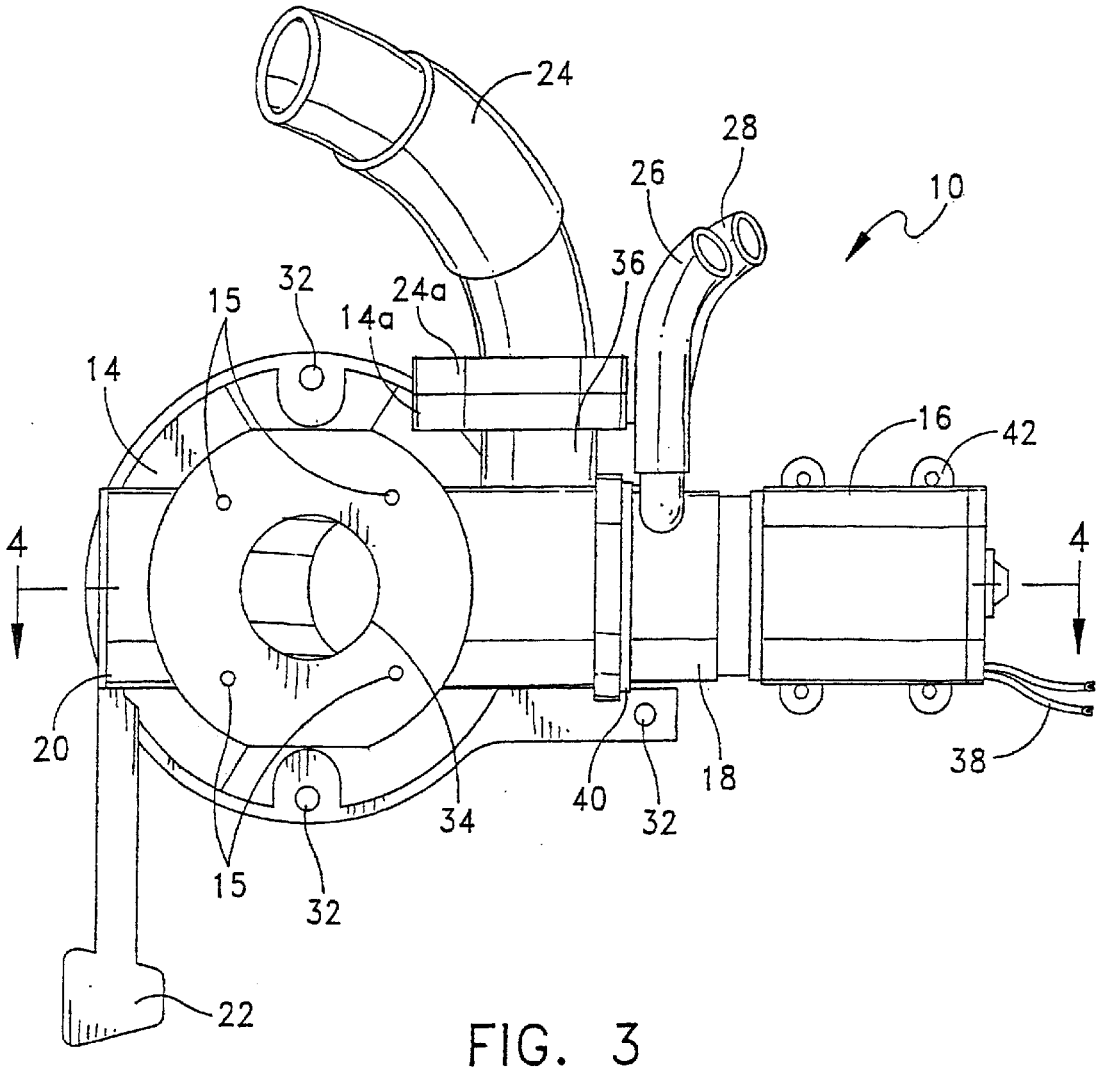
FIG. 3 is a top view of the toilet system of the present invention, with the bowl removed.
Figure 10:
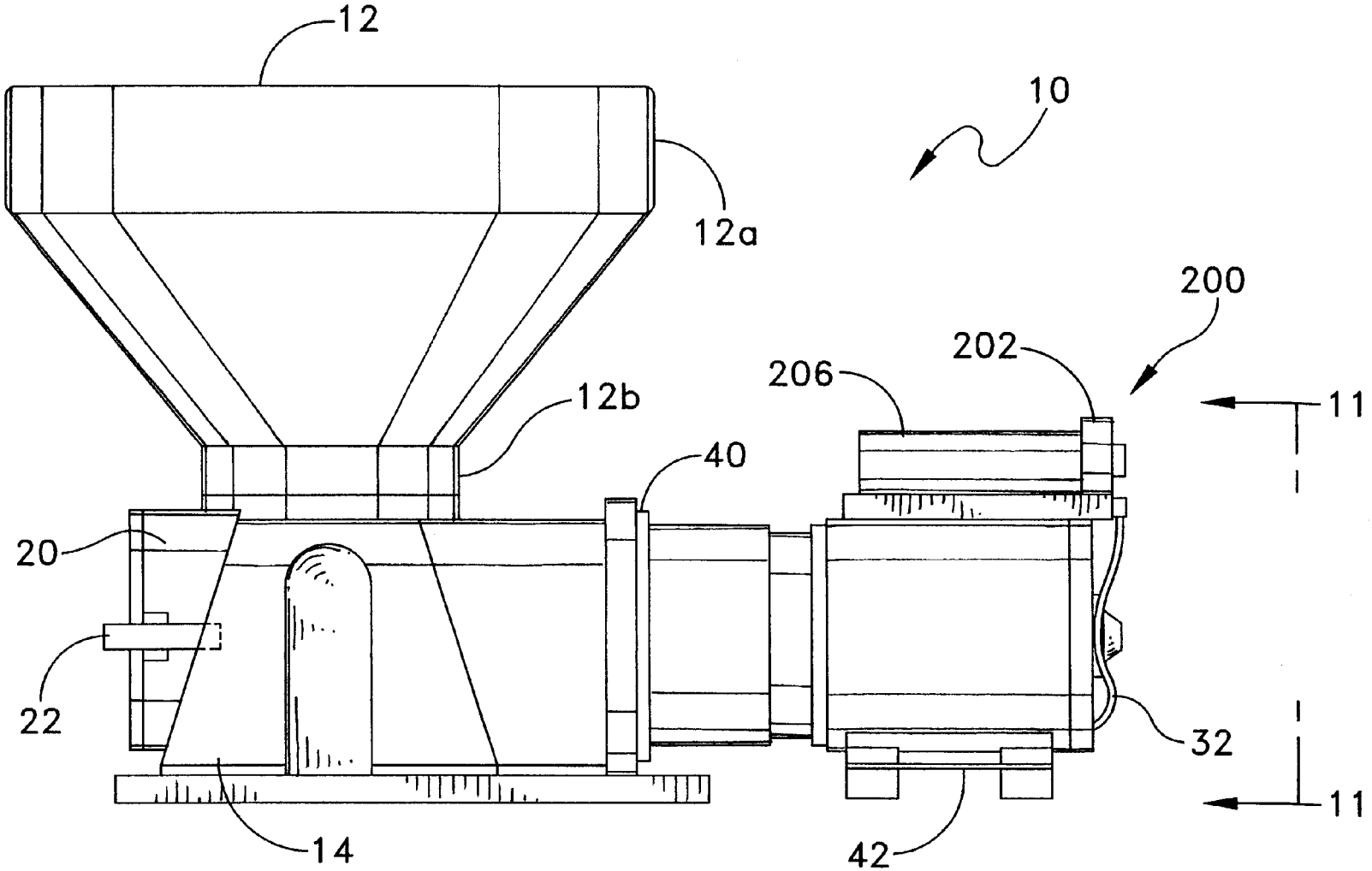
FIG. 10 is a side view of the marine vessel toilet system, showing the rechargeable battery system of the present invention.

Referring now to the drawings, and more particularly FIGS. 1–3, there is generally indicated at 10 a marine vessel toilet system of the present invention. FIG. 1 is a side view of the toilet system 10, FIG. 2 is a front view of the system 10 and FIG. 10 is a top view of the system 12, with the toilet bowl 12 removed. Marine vessel toilet system 10 includes a toilet bowl 12, having a rim portion 12*a* and a mounting plate 12*b*. Mounting plate 12*b* of toilet bowl 12 is mounted to a base unit 14 via mounting holes 15 in base unit 14. Base unit 14 is mounted to a deck of a marine vessel via mounting holes 32. Base unit 14 includes a base unit inlet port 34 and a base unit outlet port 36. A waste water outlet pipe 24 has a mounting plate 24*a* at one end which is mounted to a mounting plate 14*a* of base unit 14. The other end of waste water outlet pipe 24 is coupled to a holding tank or to an output port of the of the vessel (not shown) for evacuating waste from the toilet system 10. A switch unit 20, including a foot pedal 22 is also mounted to base unit 14. Switch unit 20 will be described in greater detail below.

Figure 4:
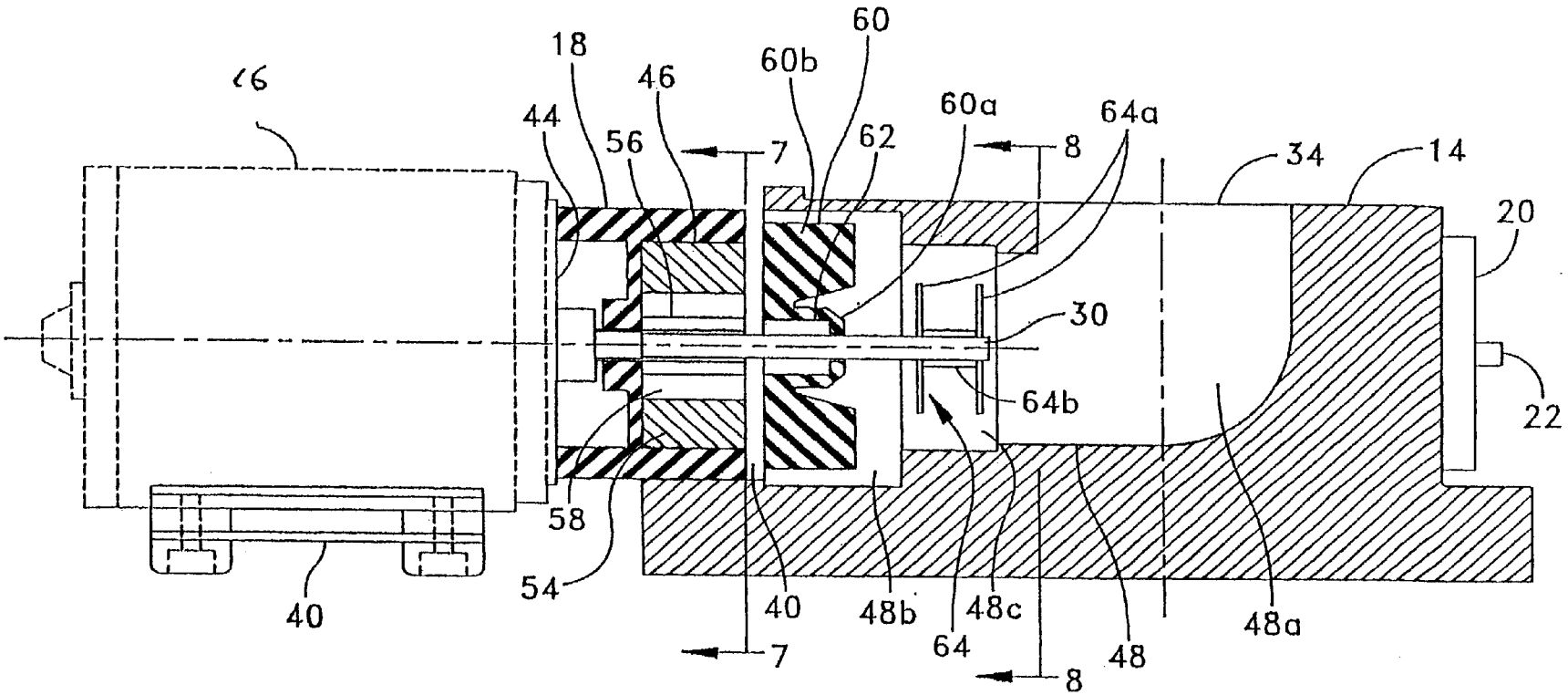
FIG. 4 is a cross sectional view of the toilet system, taken along line 4—4 of FIG. 3.
Figure 5:
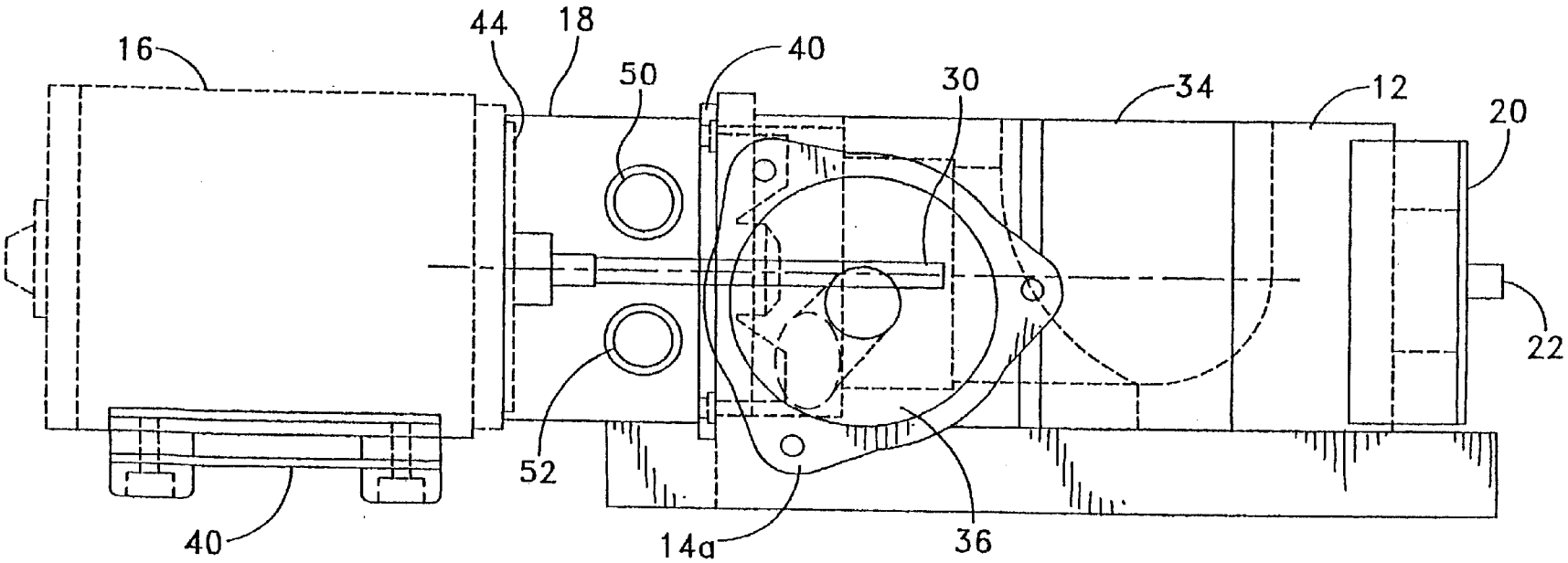
FIG. 5 is a partial cross-sectional view of the toilet system, taken along line 4—4 of FIG. 3.
Figure 6:
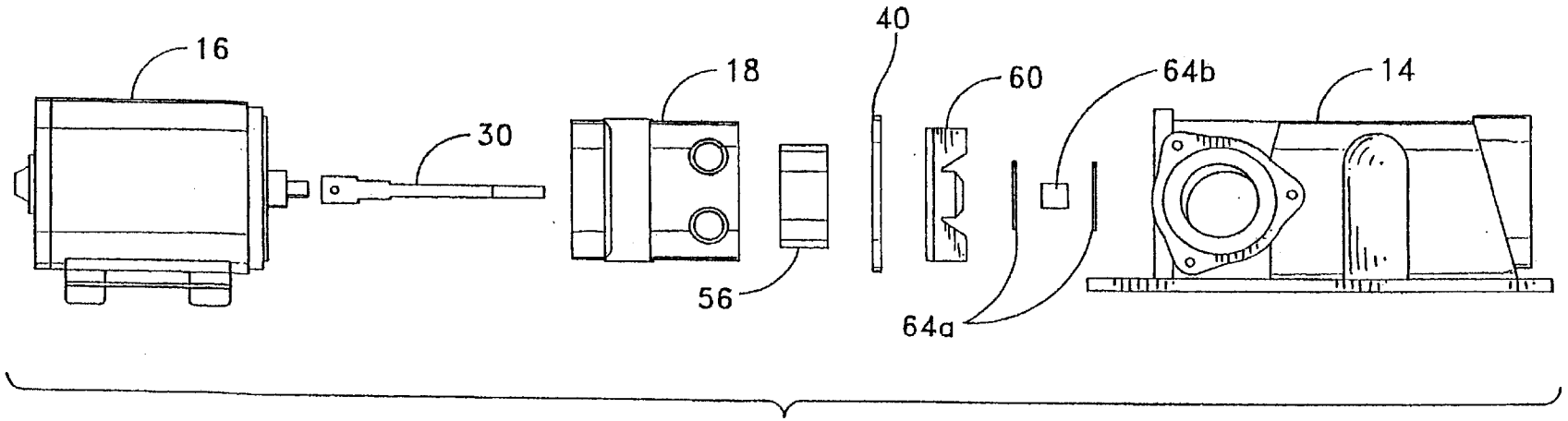
FIG. 6 is an exploded view of the toilet system shown in FIG. 4.

Toilet system 10 further includes a bidirectional motor 16 for driving a drive shaft 30, shown in FIGS. 4 and 5. FIG. 4 is a cross-sectional diagram of the system 10 taken along line 4—4 of FIG. 3 and FIG. 5 is a partial cross-sectional diagram of the system 10. In FIGS. 4 and 5, toilet bowl 12 is not shown for simplicity. Bidirectional motor 16 is connected to a power source via power leads 38. Any type of a bidirectional motor may be used as motor 16, for example, motors powered by alternating current, direct current and air power. Bidirectional motor 16 is mounted to the deck of the vessel via mounting bracket 42. Bidirectional motor 16 is coupled to an input housing 18, having an interior portion which defines a fluid input chamber 46. Input housing 18 includes a fluid input port 50, for receiving fresh water from a fresh water source (not shown) through a fresh water inlet pipe 26. While the water input into the toilet system is referred to as fresh water, this is to contrast the water with the waste water which is evacuated from the toilet system. Therefore, the fresh water referred to in this application may be fresh water from the vessel's supply tank, or fresh or salt water drawn in from outside the vessel. Housing 18 also includes a fresh water output port 52 for outputting fresh water from input chamber 46 to rim 12*a* of bowl 12 through a fresh water transfer pipe 28. Fresh water transfer pipe 28 is connected at one end to fresh water outlet port 52 of input housing 18 at another end thereof to rim 12*a* of bowl 12 in a conventional manner known in the art.

Input housing 18 is coupled to base unit 12 through an adapter plate 40, which sealingly isolates fluid input chamber 46 from fluid output chamber 48 using a series of o-rings and gaskets in a conventional manner which allows drive shaft 30 to pass from input chamber 46 into output chamber 48. Interior chamber 46 also includes a shaft seal 44 which sealingly isolates interior chamber 46 from motor 16.

Output chamber 48 includes a fluid holding portion 48*a*, a fluid discharge portion 48*b* and a chopping portion 48*c*.

Figure 7:
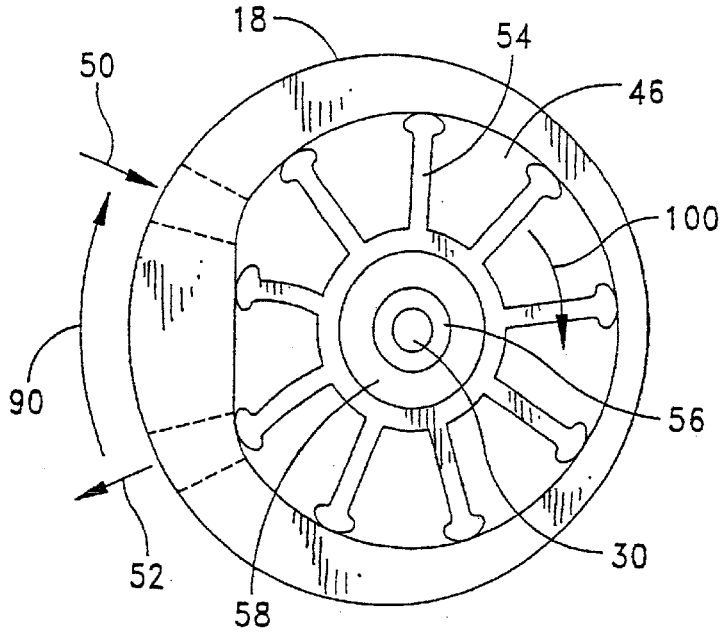
FIG. 7 is a cross-sectional view of the toilet system showing the rubber impeller of the present invention, taken along line 7—7 of FIG. 4.

Drive shaft 30 is connected to motor 16 in a conventional manner, such as with set screws. As shown in FIGS. 4 and 5, drive shaft 30 is formed of such a length that it extends from motor 16 through input chamber 46 and into output chamber 48. A rubber impeller 54, FIG. 4, is mounted on drive shaft 30 within input chamber 46. As is described in greater detail below with reference to FIG. 7, rubber impeller 54 draws fresh water from fresh water inlet pipe 26 and fresh water input port 50 into input chamber 46 and then drives the fresh water from input chamber 46 to the rim 12*a* of bowl 12 through fresh water outlet port 52 and fresh water transfer pipe 28.

In the preferred embodiment, the rubber impeller 54 is fitted with a stainless steel insert 58 at its center portion. The stainless steel insert may be permanently attached to the rubber impeller 54 through a press fit, adhesive, vulcanizing or other suitable means. The rubber impeller 54 and stainless steel insert 58 are then mounted on drive shaft 30 through a roller clutch bearing 56 which is press fit into the stainless steel insert 58. Alternatively, the stainless steel insert 58 and the roller clutch bearing 56 may be formed as a single unit which is attached to the rubber impeller 54. In the preferred embodiment, the roller clutch bearing 58 is formed from spring-loaded needle bearings which are fitted in a roller cage, which in turn is mounted within a housing. The roller clutch bearing is mounted on the drive shaft 30 such that, when the drive shaft 30 is rotated in a first direction, the springs fully extend within the roller cage and the bearings wedge between the roller cage and the drive shaft 30, causing the roller clutch bearing to lock on to the drive shaft, thereby causing the impeller to rotate in the first direction. When the drive shaft is rotated in the opposite direction, the springs compress, allowing the shaft to rotate within the bearing, without causing the impeller to rotate. Accordingly, depending on the orientation of the roller clutch bearing 56 on the drive shaft 30 and the direction of rotation of the drive shaft 30, the roller bearing is either engaged with the shaft, causing the impeller 54 to rotate, or the roller clutch bearing 56 is disengaged from the drive shaft 30, and the impeller does not rotate. This type of roller bearing is known in the art and is commonly available through, for example, Stockdrive Products of Hyde Park, New York. While this type of roller clutch bearing is preferred in the present invention, it will be understood that any bearing which allows the impeller to rotate when the drive shaft is turned in one direction and which allows the impeller to remain still while the drive shaft is rotated in the opposite direction may be used in the present invention.

An impeller 60 is mounted on drive shaft 30 within fluid discharge portion 48*b* of output chamber 48. Impeller 60 has a number of vanes 60*b* which lie in respective planes which project radially outwardly and parallel to a longitudinal axis of a central hub 60*a* of the impeller 60. Impeller 60 is preferably formed from brass and has a roller clutch bearing 62 press fit into the central hub 60*a*. Roller clutch bearing 62 is identical to roller clutch bearing 56, but is oriented to operate in an opposite fashion than roller clutch bearing 56. Specifically, when drive shaft 30 is rotated in a first direction such that roller clutch bearing 56 engages drive shaft 30, causing impeller 54 to rotate, roller clutch bearing 62 is disengaged from drive shaft 30 and impeller 60 does not rotate. Conversely, when drive shaft 30 is rotated in a second direction opposite the first direction, roller clutch bearing 56 is disengaged from drive shaft 30 and impeller 54 does not rotate, while roller clutch bearing 62 engages drive shaft 30, causing impeller 60 to rotate.

A chopping mechanism 64 is mounted on drive shaft 30 within chopping portion 48*c* of output chamber 46. In the preferred embodiment, chopping mechanism 64 is formed from a number of stainless steel blades 64*a* attached to a hub 64*b*, each of the blades 64*a* lying in plane which is perpendicular to a respective plane which projects radially outwardly from a longitudinal axis of the hub 64*b*. Alternatively, chopping mechanism 64 may be formed from any formation and orientation of blades or studs which can operate to macerate or break down any solid matter being discharged from the output chamber, as is described in greater detail below. Chopping mechanism 64 is fixed to drive shaft 30, and therefore rotates regardless of the rotating direction of drive shaft 30. However, due to the design of chopping mechanism 64, it cannot move water so it does not affect the filling and evacuating operations carried out by the impeller 56 and impeller 60, respectively.

Figure 8:
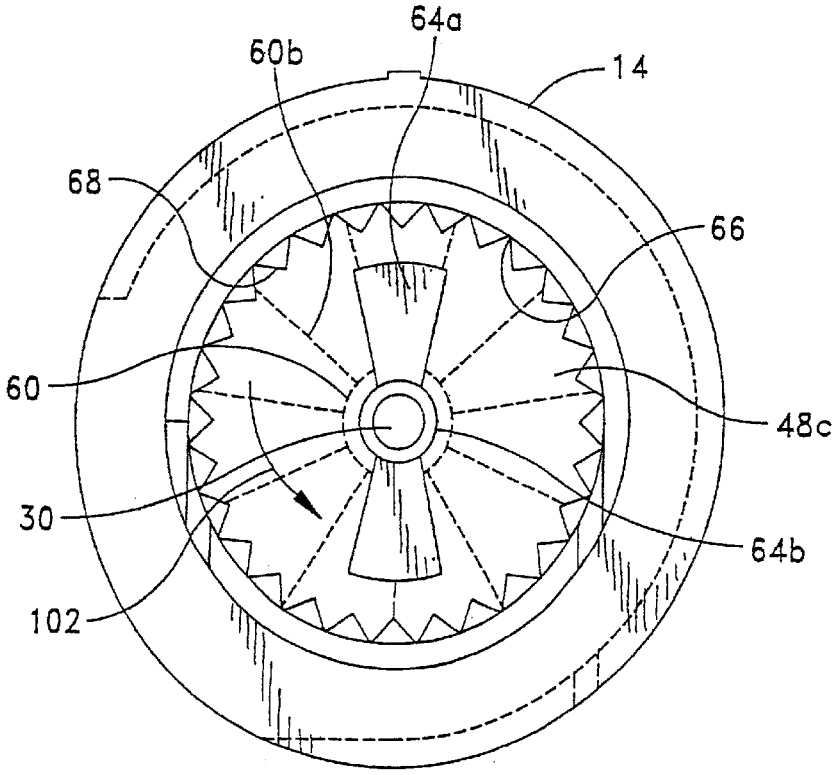
FIG. 8 a cross-sectional view of the toilet system showing the chopping portion of the present invention, taken along line 8—8 of FIG. 4.

Shown in FIG. 8, which is a cross-sectional diagram of the output chamber 48 of base unit 14 taken along line 8—8 of FIG. 4, the inner surface of the outer periphery of chopping portion 48*c* has a longitudinally ribbed structure 68 for increasing the effectiveness of chopping mechanism 64 in macerating the solid matter. Ribbed structure 68 may be integrally formed within base unit 14 or, preferably, it may be formed as a separate sleeve which is press fit into the base unit 14 and held in place using a conventional key and keyway method. Also shown in FIG. 8 is impeller 60, which is located behind chopping mechanism 64 and is shown in phantom.

Figure 9A:
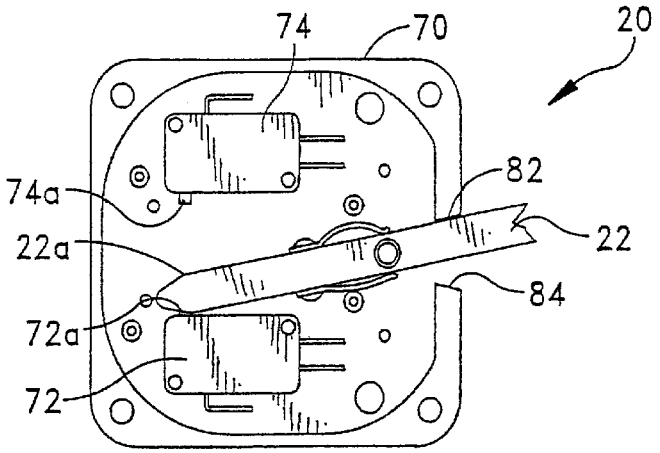
FIGS. 9, 9A and 9B show the operation of the switch mechanism of the present invention.

Switching mechanism 20 will now be described with reference to FIGS. 9, 9A and 9B. As shown in these figures, switch mechanism 20 includes a housing 70, which is mounted to base unit 14 as shown in FIGS. 1 and 2. Foot pedal 22 is pivotally attached to base 14 via a pivot bolt 80, such that its end 22*a* is allowed to pivot downwardly, as shown in FIG. 9A, and upwardly, as shown in FIG. 9B. Stops 82 and 84 of housing 70 act to limit the upward and downward travel of foot pedal 22. Switch mechanism 20 includes a pair of microswitches 72 and 74. Microswitch 72 includes a contact 72*a* and control terminals 76 and microswitch 74 includes a contact 74*a* and control terminals 78. Control terminals 76 and 78 are electrically coupled to a power supply and to the motor 16, in order to control the direction of rotation of the motor 16. Microswitches 72 and 74 are of conventional design and therefore the internal operation of the switches will not be described. Generally, when the foot pedal 22 is raised, causing end 22*a* to pivot downwardly, end 22*a* depresses contact 72*a*, as shown in FIG. 9A. As a result of this, microswitch 72 instructs motor 16 to rotate drive shaft 30 in a first direction, shown by arrow 90 in FIG. 7. As will be described further below, this causes impeller 54 to transfer water into fresh water transfer pipe 28 to fill bowl 12. Conversely, when foot pedal 22 is depressed, causing end 22*a* to pivot upwardly, end 22*a* depresses contact 74*a*, as shown in FIG. 9B. As a result of this, microswitch 74 instructs motor 16 to rotate drive shaft 30 in a second direction, opposite that shown by arrow 90 in FIG. 7. This causes impeller 60 to rotate, thereby evacuating the output chamber 48 through waste water outlet pipe 24.

Figure 9:
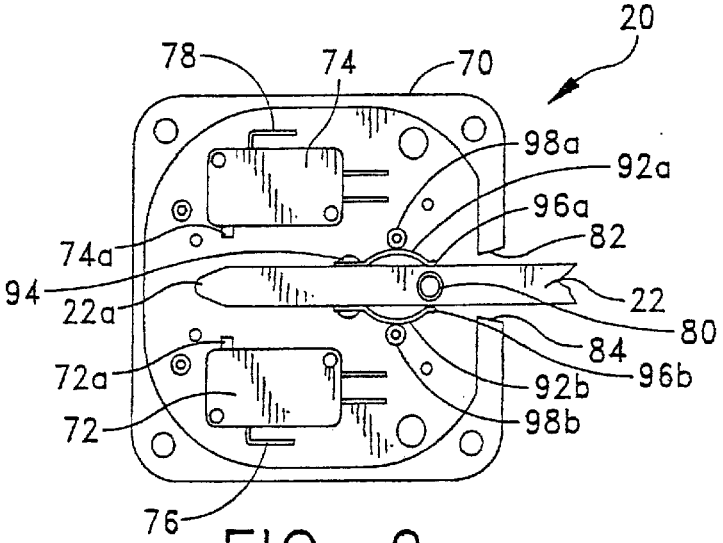
Figure 9B:
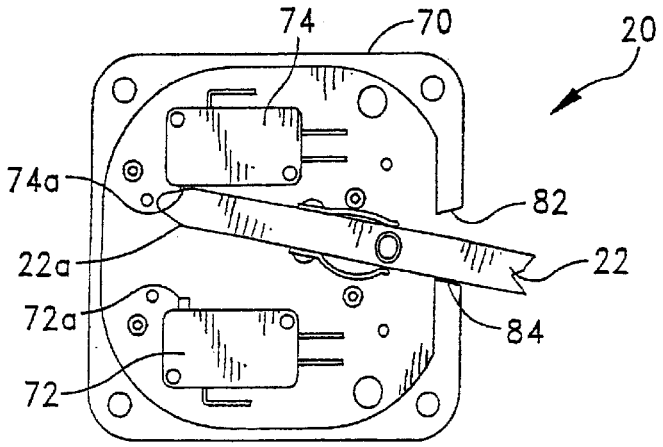

Foot pedal 22 is biased in the neutral position shown in FIG. 9 by a pair of springs 92*a* and 92*b*. Springs 92*a* and 92*b* are attached to foot pedal 22 at one end of each spring by a bolt 94, contact foot pedal 22 at the other end of each spring 96*a* and 96*b*, respectively, and are biased against posts 98*a* and 98*b*, respectively. Accordingly, when end 22*a* of foot pedal 22 pivots downwardly, as shown in FIG. 9A, spring 92*b* is compressed against post 98*b*. Similarly, when end 22*a* of foot pedal 22 pivots upwardly, as shown in FIG. 9B, spring 92*a* is compressed against post 98*a*. In either case, when foot pedal 22 is released, springs 92*a* and 92*b* return the foot pedal 22 to its neutral position, as shown in FIG. 9. A cover plate (not shown) is mounted on housing 70 to seal the switching mechanism and to protect the internal components.

The input chamber and output chamber may also include sacrificial anodes (not shown) in the form of replaceable zinc pellets which are mounted within each of the input and output chambers. Since seawater is conductive, and different metals may be present in the toilet system, the zinc will corrode first, thus sparing the other metals in the system.

The operation of the toilet system will now be described. As described above, when not in use, the output chamber 48 and bowl 12 are empty. When a person desires to use the toilet system, the output chamber 48 and the bowl must be filled with fresh water. Therefore, the user would raise foot pedal 22, causing end 22*a* to pivot downwardly, thereby depressing contact 72*a* of microswitch 72. This causes microswitch 72 to send a signal to motor 16, instructing motor 16 to drive the drive shaft 30 in the direction of arrow 90, FIG. 7. When shaft 30 rotates in this direction, roller clutch bearing 56 engages shaft 30, causing rubber impeller 54 to rotate in the direction indicated by arrow 90. Due to the cam shape of the housing 18, as rubber impeller 54 rotates, a vacuum is created at the input port 50, which causes fresh water to be drawn into input chamber 46 through input port 50. Water is driven through input chamber 46 in the direction shown by arrow 100 and discharged through output port 52. The water flows out from output port 52, through fresh water transfer pipe 28 and into rim 12*a* of bowl 12. The water flows around rim 12*a* and into bowl 12 and output chamber 48 through a series of holes (not shown) located around the periphery of rim 12*a*. The user controls the amount of water which is transferred into the bowl 12 and output chamber 48 by releasing the foot pedal 22 when the desired amount of water is in the bowl 12 and output chamber 48.

Due to the orientation of roller clutch bearing 62 of impeller 60, when drive shaft 30 is rotated in the direction indicated by arrow 90, roller clutch bearing 62 is disengaged from drive shaft 30 and impeller 60 does not rotate.

When the user desires to evacuate the toilet system, the foot pedal 22 is depressed, causing end 22*a* to pivot upwardly, thereby depressing contact 74*a* of microswitch 74. This causes microswitch 74 to send a signal to motor 16, instructing motor 16 to drive the drive shaft 30 in the direction opposite that indicated by arrow 90, FIG. 7. When shaft 30 rotates in this direction, roller clutch bearing 62 engages drive shaft 30, causing impeller 60 to rotate in the direction indicated by arrow 102, FIG. 8. Since chopping mechanism 64 is fixed to drive shaft 30, it also rotates in this direction. Any solid material which is in the output chamber 48 is macerated within chopping portion 48*c* of output chamber 48. At the same time, impeller 60 pushes the waste water through base unit outlet port 36 and into waste water outlet pipe 24 for disposal of the waste water either in a holding tank or overboard of the vessel. Base unit outlet port 36 includes a valve (not shown) which allows waste to be discharged from the output chamber 48, but does not allow the waste to backflow into the output chamber 48 from waste water outlet pipe 24.

Due to the orientation of roller clutch bearing 56 of impeller 54, when drive shaft 30 is rotated in the direction opposite that indicated by arrow 90, roller clutch bearing 54 is disengaged from drive shaft 30 and impeller 54 does not rotate.

Figure 11:
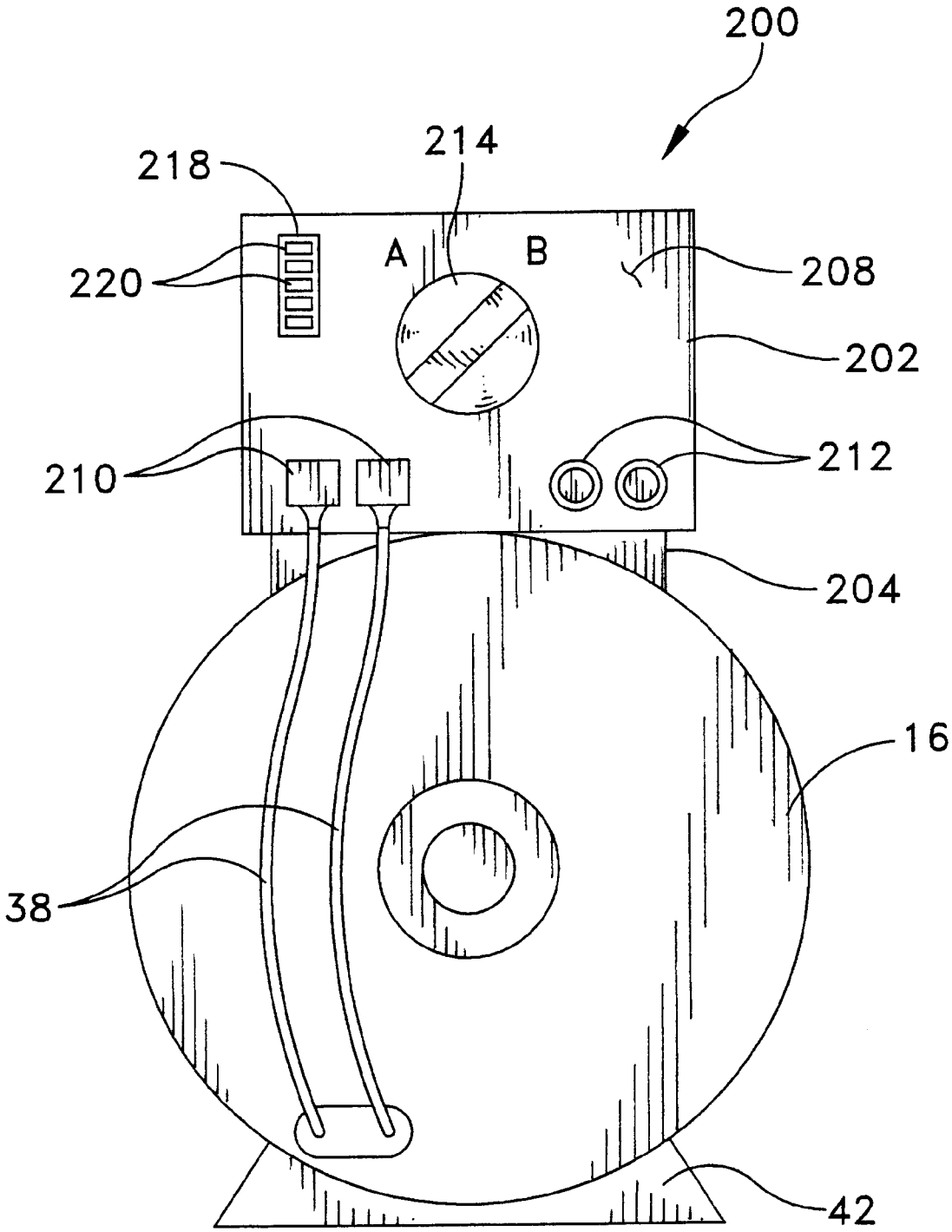
FIG. 11 is an end view of the marine vessel toilet system showing the rechargeable battery system, as seen from line 11—11 in FIG. 10.
Figure 12:
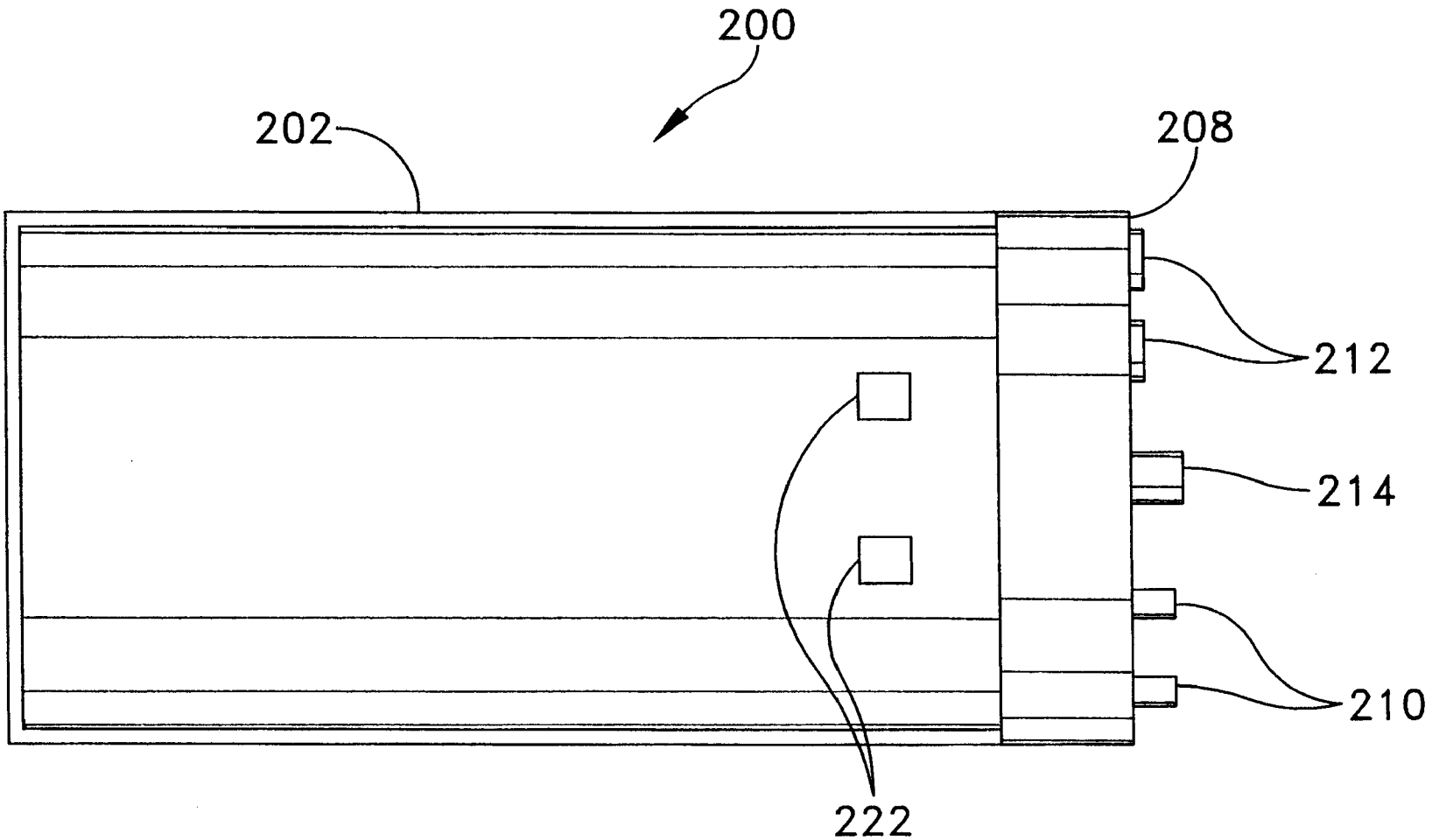
FIG. 12 is a top view of the mounting cradle of the rechargeable battery system of the present invention with the battery removed.

Referring now to FIGS. 10–12, the rechargeable battery system, generally indicated at 200, for the marine vessel toilet system 10, will be described. Shown in FIG. 10 is a side view of the rechargeable battery system 200 mounted on the marine vessel toilet system 10, and, in FIG. 11 is an end view of the battery system 200 and toilet system 10, as seen from line 11—11 in FIG. 10. As can be seen in the figures, the system 200 includes a battery mounting cradle 202 which is mounted over the housing of bidirectional motor 16 via a mounting bracket 204. A 12 volt rechargeable battery 206 is removably mounted in the mounting cradle 202. It will be understood that rechargeable battery 206 may be formed from any battery technology such as lead acid, NiCad, NiMH, lithium ion, etc. The only requirement for the battery 206 is that it be sealed, for protection against the marine conditions, and rechargeable. Furthermore, the voltage of the battery 206 should be chosen to match the power requirements of the motor 16. Accordingly, if the motor 16 required, for example, 24 volts, then the battery 206 would provide 24 volts. The battery 206 is rechargeable using common recharging technology known in the art.

Mounting cradle 202 includes a control panel 208 which includes a pair of power output contacts 210 to which the power leads 38 of the motor 16 are connected to enable power to be directed to the motor 16 through the mounting cradle 202. Control panel 208 also includes a pair of auxiliary power leads 212 to which an auxiliary power source 216 (FIG. 13), such as the marine vessel's house batteries, may be connected for back-up power. A switch 214 allows the power which is delivered to the motor 16 via the power output contacts 210 to be switched between the battery 206 and the auxiliary power source 216. A battery charge indicator 218 includes a series of visual indicators 220, such as lights, for indicating the remaining charge in the battery 206. As can be seen in FIG. 12, which is a top view of the mounting cradle 202, shown with the battery 206 removed, the mounting cradle 202 includes a pair of contacts 222, for mating with power contacts (not shown) of the battery.

Figure 13:
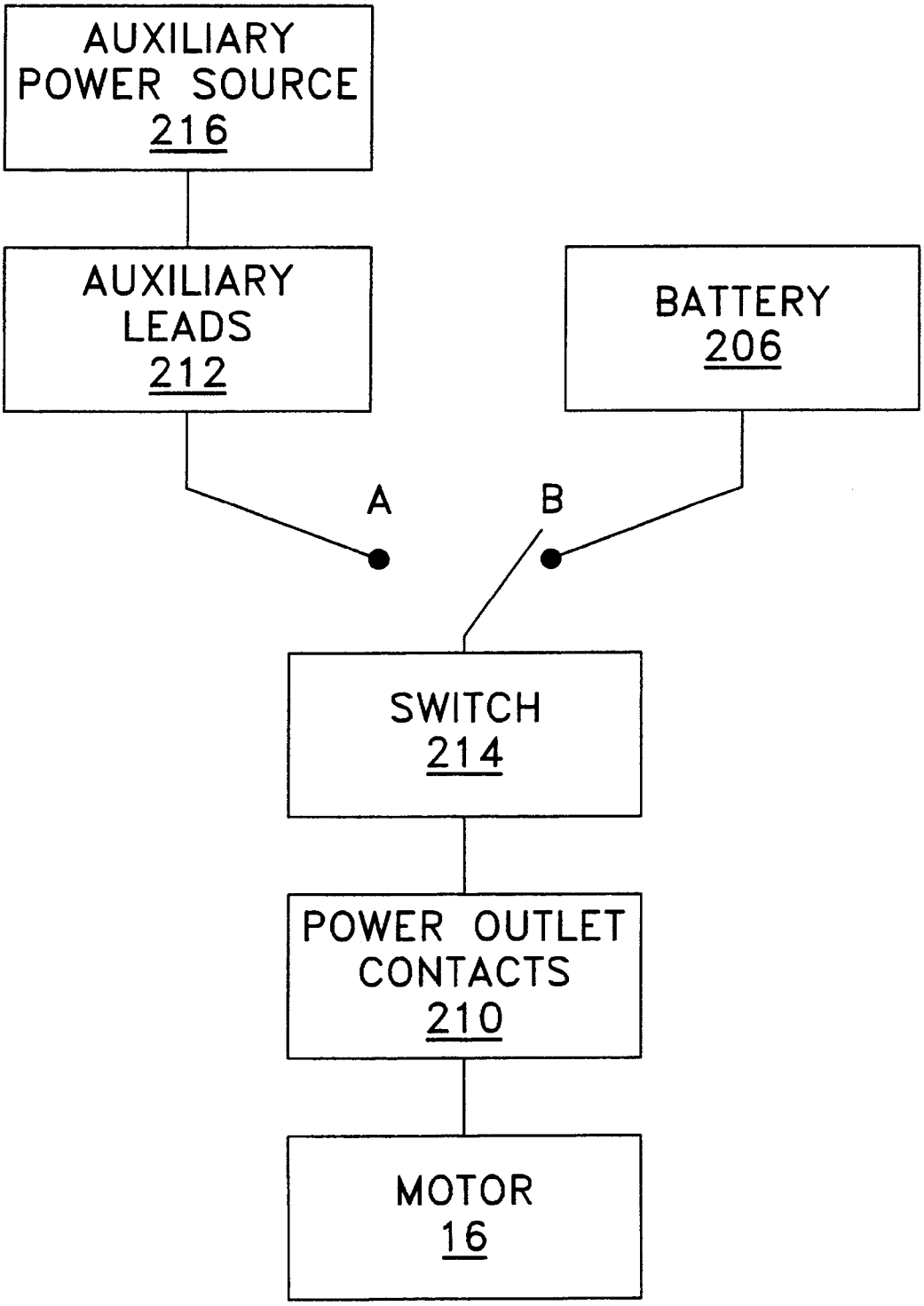
FIG. 13 is a block diagram showing the components of the rechargeable battery system of the present invention.

FIG. 13 schematically shows this configuration of the cradle 202 in the form of a block diagram. As shown in FIG. 13, the switch 214 enables the source of power to be switched between the battery 206 and the auxiliary power supply 216 via auxiliary power leads 212. Once the position of the switch is set to either the "A" position, for a connection between the auxiliary power supply 216 and the power output contacts 210, or the "B" position, for a connection between the battery 206 and the power output contacts 210, power is supplied to the motor 16 via the power output contacts 210.

In operation, the switch 214 would normally be set to the "B" position such that the motor 16 of the toilet system 10 is powered by the rechargeable battery 206. In the case that the battery 206 runs out of power, the switch 214 would be moved to the "A" position, thus powering the motor 16 with the auxiliary power source 216, which, as described above, could be the house batteries of the marine vessel.

Therefore, the present invention provides an electric marine toilet system which relies on a rechargeable battery and not on the house batteries of the marine vessel for power, thereby conserving the house batteries for other, more important, uses. However, if the rechargeable battery were to run out of power, the toilet could be switched over to be powered by an auxiliary power source such as the house batteries.

While there is shown and described herein certain specific structure embodying the invention, it will be manifest to those skilled in the art that various modifications and rearrangements of the parts may be made without departing from the spirit and scope of the underlying inventive concept. For example, the cradle 202 may be mounted in any suitable location on the vessel and may be made from any suitable material which is capable of withstanding corrosion which can take place due to the presence of water, and especially salt water, on a marine vessel. Such materials include aluminum and plastics. Furthermore, the cradle could be configured to allow the rechargeable battery 206 to be recharged by the house battery when the switch is in the "A" position, such that the cradle is connected to the auxiliary power source 216. Also, the charge indicator 218 may include any suitable form of visual indicator and, while the invention has been described as being drawn to a marine vessel toilet system, the system may be used for any application, including recreational vehicles and portable toilets. Accordingly, the inventive concept is not limited to the particular forms herein shown and described.

What is claimed is:

1. A battery system for an electric motor-powered marine vessel toilet, the battery system comprising:

a mounting cradle;

a battery having power contacts, said battery being detachably mounted to said mounting cradle;

said mounting cradle including:

cradle contacts for mating with said contacts of said battery;

output contacts adapted to be coupled to input power contacts of the motor for providing power to the motor;

auxiliary contacts for receiving power from an auxiliary power source; and a switch for connecting said output contacts to one of said cradle contacts and said auxiliary contacts for supplying power to the motor via said output contacts.

2. The battery system of claim 1, wherein said auxiliary power source is an on-board house battery for a marine vessel.

3. The battery system of claim 1, further comprising a visual indicator which displays a remaining charge in said battery.

4. The battery system of claim 1, wherein said battery is rechargeable.

5. The battery system of claim 4, wherein said battery is formed from a battery material selected from the group consisting of lead acid, nickel cadmium, nickel metal hydride and lithium ion.

6. A fluid circulation system comprising:

a motor;

a first housing having a fluid inlet and a fluid outlet;

a second housing having a fluid inlet and a fluid outlet;

a fluid holding device coupled between said fluid outlet of said first housing and said fluid inlet of said second housing;

a drive shaft operatively coupled to said motor to be driven by said motor, said drive shaft extending from said motor into said first and second housings;

a first fluid transfer device mounted on said drive shaft within said first housing, said first fluid transfer device being operative to transfer fluid from said fluid inlet of said first housing, through said fluid outlet of said first housing and into said fluid holding device;

a second fluid transfer device mounted on said drive shaft within said second housing, said second fluid transfer device being operative to transfer water from said fluid holding device, through said fluid inlet of said second housing and through said fluid outlet of said second housing; and a battery system which is electrically coupled to said motor for supplying power thereto, said battery system comprising a mounting cradle;

a battery having power contacts, said battery being detachably mounted to said mounting cradle;

said mounting cradle including cradle contacts for mating with said contacts of said battery;

output contacts coupled to input power contacts of the motor for providing power to the motor, auxiliary contacts for receiving power from an auxiliary power source; and a switch for connecting said output contacts to one of said cradle contacts and said auxiliary contacts for supplying power to the motor via said output contacts.

7. The system of claim 6, wherein said fluid circulation system is a marine vessel toilet.

8. The system of claim 6, wherein said auxiliary power source is an on-board house battery for a marine vessel.

9. The system of claim 6, further comprising a visual indicator which displays a remaining charge in said battery.

10. The system of claim 6, wherein said battery is rechargeable.

11. The system of claim 10, wherein said battery is formed from a battery material selected from the group consisting of lead acid, nickel cadmium, nickel metal hydride and lithium ion.

* * * * *